US009290298B2

(12) United States Patent
Linares

(10) Patent No.: US 9,290,298 B2
(45) Date of Patent: Mar. 22, 2016

(54) PLASTIC COATED PALLET ARTICLE EXHIBITING VARYING SURFACE PATTERNS FOR ASSISTING IN FLUID DRAINAGE, GASEOUS RELEASE AND FRICTIONAL RETENTION OF ITEMS SUPPORTED THEREUPON

(71) Applicant: Oria Collapsibles, LLC, Auburn Hills, MI (US)

(72) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 0 days.

(21) Appl. No.: 14/592,619

(22) Filed: Jan. 8, 2015

(65) Prior Publication Data

US 2015/0191275 A1 Jul. 9, 2015

Related U.S. Application Data

(60) Provisional application No. 61/925,606, filed on Jan. 9, 2014.

(51) Int. Cl.
*B65D 19/00* (2006.01)

(52) U.S. Cl.
CPC ..... *B65D 19/004* (2013.01); *B65D 19/0002* (2013.01); *B65D 2205/00* (2013.01); *B65D 2519/008* (2013.01); *B65D 2519/00019* (2013.01); *B65D 2519/00029* (2013.01); *B65D 2519/00034* (2013.01); *B65D 2519/00044* (2013.01); *B65D 2519/00054* (2013.01); *B65D 2519/00064* (2013.01); *B65D 2519/00069* (2013.01); *B65D 2519/00079* (2013.01); *B65D 2519/00338* (2013.01); *B65D 2519/00343* (2013.01); *B65D 2519/00835* (2013.01)

(58) Field of Classification Search
CPC ..... B65D 19/44; B65D 19/38; B65D 2519/00313; B65D 2519/00328; B65D 2519/00348; B65D 2519/00069
USPC ..... 108/57.25, 55.3, 55.1, 51.11; 248/346.02; 206/386, 598
See application file for complete search history.

(56) References Cited

U.S. PATENT DOCUMENTS

| | | | | |
|---|---|---|---|---|
| 2,444,326 | A * | 6/1948 | Baker et al. | 108/55.3 |
| 3,400,671 | A | 9/1968 | Erismann | |
| 3,433,184 | A * | 3/1969 | Addy | 108/53.3 |

(Continued)

*Primary Examiner* — Jose V Chen
(74) *Attorney, Agent, or Firm* — Dinsmore & Shohl LLP; Douglas J. McEvoy

(57) ABSTRACT

A structurally supporting pallet exhibiting a plurality of either individual or networked portions configured with or upon an upper base surface such that, upon placing a cargo load upon the body, it provides drainage or ventilation pathways extending to each of the four outer interconnecting edges of the body. In a first example, the cargo supporting surface is exhibited by a plurality of individual plateau defining portions, each of which exhibiting a plurality of perimeter defining and upwardly sloping edges extending from a base surface and merging into uppermost individual and coplanar defined plateaus. In a further example, a plurality of elongated recessed channels are configured in the base surface and extend between selected sides of the article. In each instance, the article includes a plastic coating which is configured into the desired pattern corresponding to the upper base surface. The plastic can include a grit entrained or textured surface to facilitate anti-slip properties.

7 Claims, 11 Drawing Sheets

(56) References Cited

U.S. PATENT DOCUMENTS

| | | | | | |
|---|---|---|---|---|---|
| 3,561,375 | A | | 2/1971 | Hammond et al. | |
| 3,664,570 | A | * | 5/1972 | Kupersmit | 206/386 |
| 3,938,818 | A | | 2/1976 | Studeny et al. | |
| 3,993,168 | A | * | 11/1976 | Kubick | 108/53.1 |
| 4,580,680 | A | * | 4/1986 | Wind | 206/386 |
| 4,653,651 | A | * | 3/1987 | Flum | 211/59.4 |
| 4,735,321 | A | * | 4/1988 | Day | 206/597 |
| 4,932,537 | A | | 6/1990 | Martinsen | |
| 5,197,395 | A | | 3/1993 | Pigott et al. | |
| 5,343,814 | A | | 9/1994 | Pigott et al. | |
| 5,413,052 | A | * | 5/1995 | Breezer et al. | 108/56.1 |
| 5,440,998 | A | | 8/1995 | Morgan, IV et al. | |
| 5,531,327 | A | * | 7/1996 | Darby | 206/600 |
| 5,845,588 | A | * | 12/1998 | Gronnevik | 108/57.27 |
| 6,101,955 | A | | 8/2000 | Salce | |
| 6,186,078 | B1 | * | 2/2001 | Brown | 108/57.25 |
| 6,199,488 | B1 | | 3/2001 | Favaron et al. | |
| 6,289,823 | B1 | * | 9/2001 | Koefelda et al. | 108/53.3 |
| 6,305,301 | B1 | * | 10/2001 | Piper et al. | 108/57.25 |
| 6,382,108 | B1 | * | 5/2002 | Stanek et al. | 108/55.1 |
| 6,484,877 | B1 | * | 11/2002 | Murakami et al. | 206/303 |
| 6,530,476 | B1 | * | 3/2003 | Overholt | 206/386 |
| 6,997,113 | B1 | | 2/2006 | Harding et al. | |
| 7,748,329 | B2 | * | 7/2010 | Baltz | 108/56.1 |
| 7,845,113 | B2 | | 12/2010 | Casimaty et al. | |
| 8,178,186 | B2 | * | 5/2012 | Bazbaz | 428/156 |
| 8,230,793 | B2 | | 7/2012 | Apps | |
| 8,291,839 | B2 | * | 10/2012 | Apps et al. | 108/57.25 |
| 8,317,150 | B2 | * | 11/2012 | Baechle | 248/346.01 |
| 8,347,794 | B2 | | 1/2013 | Muirhead | |
| 2005/0115473 | A1 | | 6/2005 | Schutz | |
| 2005/0211139 | A1 | * | 9/2005 | Perrotta et al. | 108/57.25 |
| 2006/0249058 | A1 | | 11/2006 | Moore et al. | |
| 2009/0325720 | A1 | | 12/2009 | Chapman | |
| 2010/0043676 | A1 | * | 2/2010 | Apps et al. | 108/53.3 |
| 2011/0100268 | A1 | * | 5/2011 | Milkowski et al. | 108/55.3 |
| 2011/0303128 | A1 | | 12/2011 | Linares | |
| 2012/0255261 | A1 | * | 10/2012 | Jositas et al. | 53/447 |
| 2014/0158025 | A1 | | 6/2014 | Apps | |
| 2014/0238278 | A1 | * | 8/2014 | Nepper et al. | 108/53.3 |
| 2014/0283713 | A1 | * | 9/2014 | Baltz et al. | 108/50.11 |

* cited by examiner

PLASTIC COATED PALLET ARTICLE EXHIBITING VARYING SURFACE PATTERNS FOR ASSISTING IN FLUID DRAINAGE, GASEOUS RELEASE AND FRICTIONAL RETENTION OF ITEMS SUPPORTED THEREUPON

CROSS REFERENCE TO RELATED APPLICATIONS

The present application claims priority of U.S. Ser. No. 61/925,606, filed Jan. 9, 2014, the contents of which is incorporated herein in its entirety.

BACKGROUND OF THE INVENTION

1. Field of the Invention

The present invention is directed to a pallet or other like cargo supporting article which can be produced in an injection molding or like process. Each of the pallet articles includes a number of variations in surface patterning, the configuration of which can be optimized in order to achieve any one or more of fluid drainage, gaseous release or frictional retention of cargo items supported thereupon.

2. Background of the Relevant Art

The prior art is documented with numerous examples of pallet-like articles exhibiting some form of texturized or configured surface. A first example of this is the nestable pallet of Koefelda, U.S. Pat. No. 6,289,832 which teaches a top deck having openings formed therein and which correspond with foot portions. The openings each define a pocket for receiving a foot portion of a like pallet in a nesting orientation. In further embodiments, the pockets include at least one drainage aperture and/or at least one nesting stop portion associated with the upper surface of the top deck.

U.S. Pat. No. 6,101,955, to Salce, teaches a plastic pallet cover for isolating a pallet load from the wood surface of the pallet. The pallet cover is formed by a molding operation and includes a grid of internal ribs and edge walls to provide strength, rigidity and positional stability. The upper surface of the pallet cover includes raised extrusions to improve the friction grip on the pallet load, as well as drainage and weep holes to prevent contaminating fluids from collecting, stagnating and comingling on the surface of the isolating cover or on the underlying pallet.

Additional examples of pallet structure with surface configurations include each of Favaron, U.S. Pat. No. 6,199,488, Martinsen, U.S. Pat. No. 4,932,537, and Hammond, U.S. Pat. No. 3,561,375. Of these, Martinsen exhibits surface drainage apertures and Hammond an upper mold surface exhibiting open ended drainage, ventilating and reinforcing channels and rows of bosses formed in its lower surface spaced apart to receive forklift prongs.

SUMMARY OF THE PRESENT INVENTION

The present invention discloses a structurally supporting pallet article exhibiting a variety of unique surface supporting configurations not taught by the prior art and which provide a combination of drainage, ventilation and frictional/textured surface supporting aspects. In each instance, the article exhibits a body having an upper supporting surface. A plurality of either individual or networked portions are configured with or upon the upper surface such that, upon placing a cargo load upon the body, define at least one of drainage or ventilation pathways extending to each of the four outer interconnecting edges of the body.

In a first example, the cargo supporting surface is exhibited by a plurality of individual plateau defining portions, each of which exhibiting a plurality of perimeter defining and upwardly sloping edges extending from a base surface and merging into uppermost individual and coplanar defined plateaus. In a further example, a plurality of elongated recessed channels are configured in the base surface and extend between selected sides of the article.

In each instance, the article includes a plastic coating which is configured into the desired pattern corresponding to the upper base surface. The plastic can include a grit entrained or textured surface to facilitate anti-slip properties.

Also disclosed is a kit for producing the article and including at least one of a mold and a template for forming the cargo supporting upper surface of the body. Additional variants also include a plurality of apertures defining inner extending rim edges within the body in communication with the upper surface for establishing hand-holds as well as facilitating drainage and ventilation.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

The present invention is directed to a pallet or other like cargo supporting article which can be produced in an injection molding or like process and which discloses variations in surface patterning which can be provided in alternating or combined fashion in order to achieve any one or more of fluid drainage, gaseous release or frictional retention of cargo items supported thereupon. As will be further described with reference to the various embodiments, the pallet (see for example as shown at 10 in FIG. 10) is constructed of any substrate material 12 not limited to any type of rigid corrugated paperboard or other natural or synthetic material.

As shown, the pallet includes a top surface exhibiting any desired configuration or varying/repeating pattern, such as are described in the several illustrations. The sides of the pallet (again at 10 in FIG. 10) can include recessed locations (see interconnected and underside accessible surfaces 12, 14 and 16 associated with a selected side extending locations), the configuration of which receives is adapted to receive inserting forks of a forklift device for moving the pallet and any supported cargo.

The various surface configurations of the pallet shown can each further include a coated top surface, such as plastic or other settable/formable material, not limited to any type of polyurethane or other material which defines an environmentally sealing and durable surface layer, and which, as will be described in detail, exhibits any of a variety of different configurations or profiles. Other variations of pallet or structural supporting platforms can additionally exhibit coated surfaces along each of its sides and interconnecting undersides.

Without limitation, the surface profiles depicted herein can be incorporated into any structurally designed pallet, including existing wooden 2×4 pallets upon which a sheet exhibiting a top plastic layer is applied, and can also include forming the surface profiles, such as by injection molding or forming in a mold within which the pallet is also concurrently formed or is pre-inserted in substrate blank form. It is also envisioned that the surface profile designs depicted herein can be separately produced in sheet form for application to other planar surface supporting applications not limited to pallets.

Figure 1:
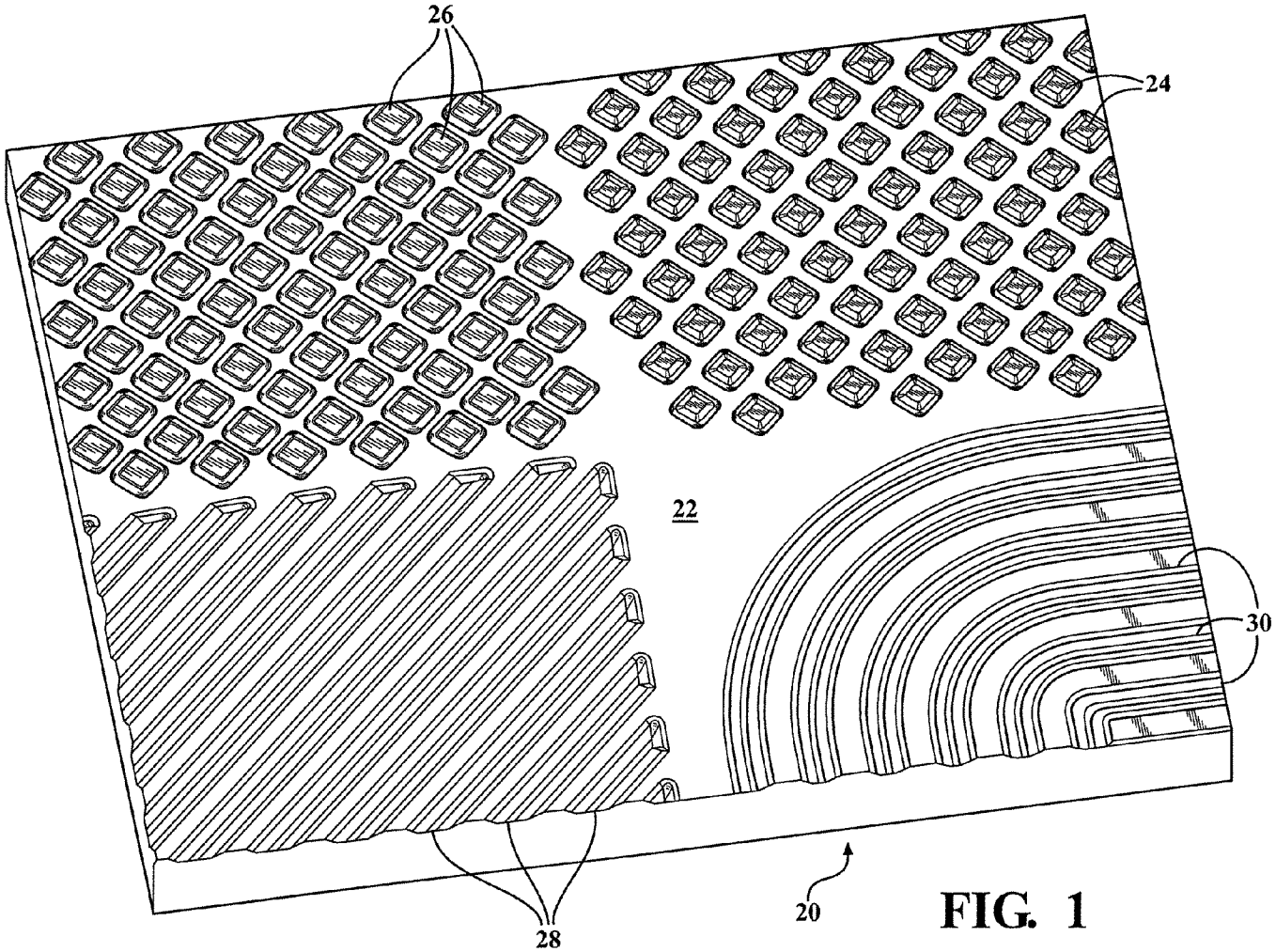
FIG. 1 is a perspective illustration of a pallet article with a variety of surface configured profiles according to one non-limiting embodiment of the present invention.

The above said, FIG. 1 is a perspective illustration, generally at 20, of a pallet article exhibiting a variety of surface configured profiles according to a first non-limiting embodiment of the present invention. The pallet 20 can be of any structural configuration not limited to that previously depicted at 10 in FIG. 10 and is exemplary shown as a solid three dimensional and rectangular shaped article exhibiting at least a coated or injection molded upper base surface 22.

As further shown, individual pluralities of surface portions are generally depicted at each of 24, 26, 28 and 30, these being depicted in individually segregated fashion along subset surface areas covering each of four quadrants of the upper base surface 22. It is understood that the individual plurality of surface portions can be provided alternately or in other combinations, as well as interspersed or otherwise intermixed, depending upon the interior configuration of the associated mold cavity, template insert associated with an upper cavity inside surface, or the like. To this end, the present invention contemplates the incorporation or use of any structure, which can include any type of mold or die (such as again exhibiting a customizable template or insert) for repetitively forming relatively flat surfaced articles exhibiting the desired surface profiles.

Figure 2:
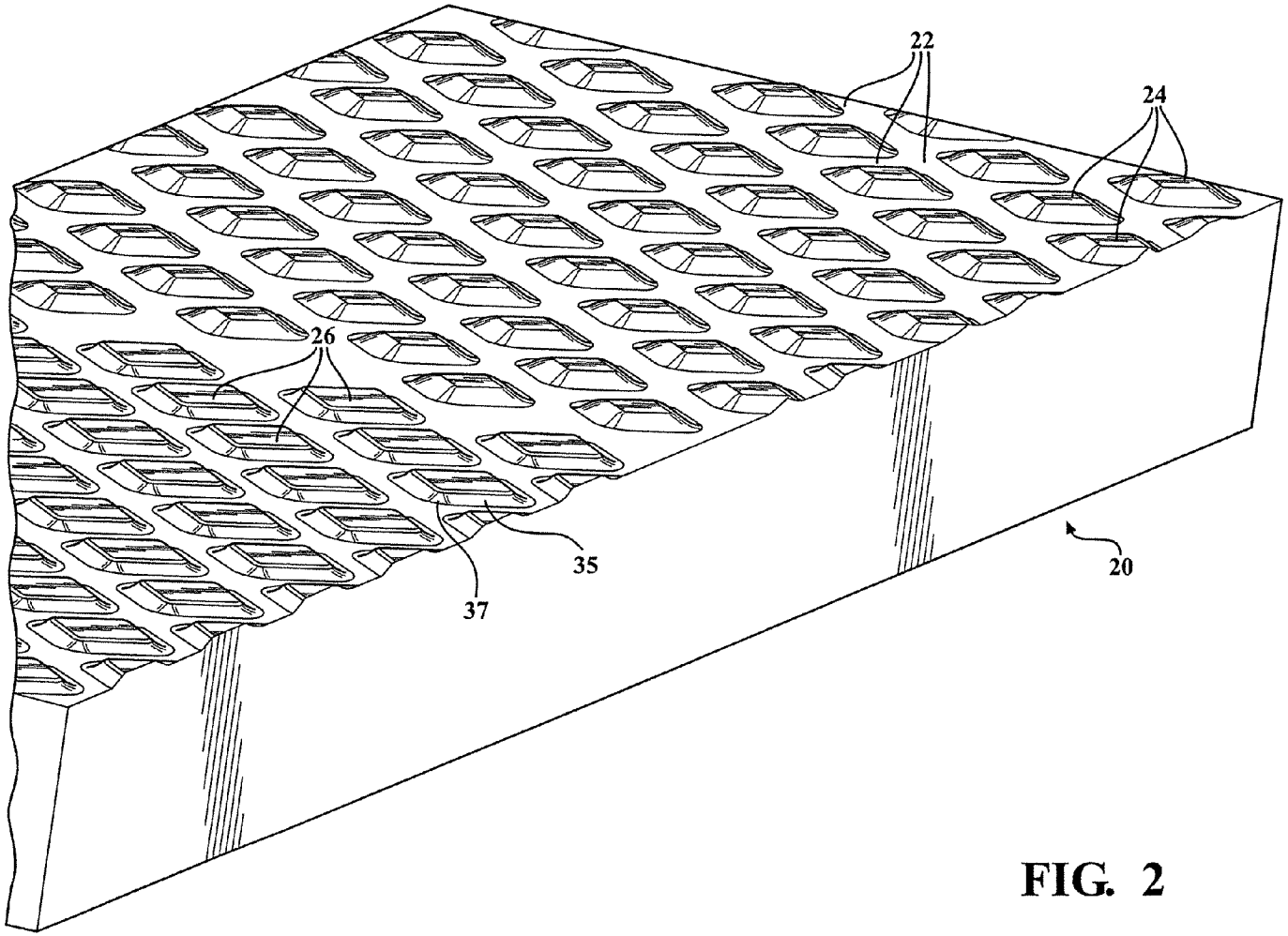
FIG. 2 is a close up perspective cutaway of a first subset portion of raised surface areas associated with the pallet article of FIG. 1 with interspersed recessed areas.

FIG. 2 is a close up perspective cutaway of the pallet 20 and exhibiting a first of the individual pluralities of subset portions (also termed subset areas), again at 24, and exhibited by raised generally rectangular shaped protuberances defining smooth sloping sides and interconnecting ends which merge into the (generally level) surface 22 of the article 20. The sloping sides, as further described in FIG. 3, extend inwardly to further define elevated central plateaus, these being coplanar with one another and which collectively define a cargo supporting area a specified elevation above the base surface 22.

As further shown, each of the individual pluralities of surfaced portions (including either or both of raised or recessed subset surface areas as again shown in 24, 26, 28 and 30) are interspersed with the level surface 22 and in order to give the article a desired irregular pattern, such as again in order to provide any or all of liquid or gaseous escape or drainage and frictional (lateral supporting) properties. This is particularly of advantage when transporting cargo, which can include controlled emission or ventilation properties or requirements. Without limitation, the elevated coplanar and cargo load support or plateau surfaces, again established by the individual elevated plateaus, can be any distance above the base surface 22, (such as in one non-limiting instance being an ⅛" or more) and again in order facilitate not only fluid drainage from the cargo supported load, but to also provide adequate underside ventilation (such as associated with perishables and the like).

Figure 2A:
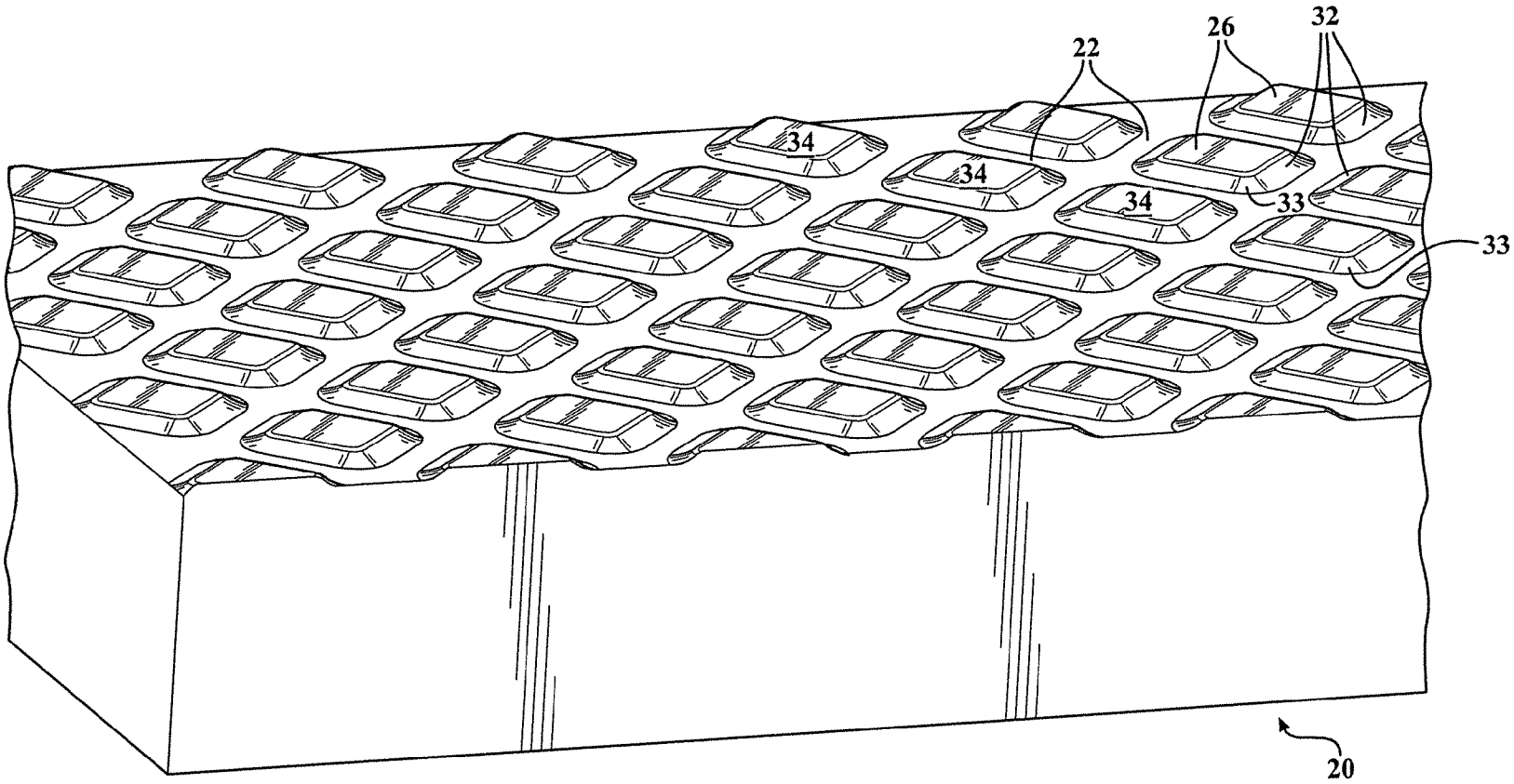
FIG. 2A is a further close up perspective of the subset surface configured profiles of FIG. 1 shown from another angle.

Proceeding to FIG. 2A, a further close up perspective of related subset surface configured profiles 26, also shown in FIG. 1, is again shown from another angle, and which also better illustrates the manner in which a plurality of smooth and sloping profiles exhibited by each of the perimeter extending edges or skirts (see at 32) of each profile 26 merges between the base upper surface 22 and the individual raised plateaus (see as further shown at 34). As further clearly shown in FIGS. 1-3, similarly arranged profiles 24 exhibit a like sloping periphery however can, without limitation, exhibit any other desired shape or configuration, not limited to circular or any other perimeter defining polygon which may include any decorative aspect combined with its functionality.

Referencing again FIG. 2A, the perimeter edges/skirts 32 are shown as linear extending portions, these alternating with arcuate edge interconnecting edge portions 33 to collectively define a four sided or other desired boundary profile associated with the individual elevating profile or area. Likewise, the corresponding raised portions/areas 26 in FIG. 2, also include similar perimeter extending skirts or edges depicted by linear portions 35 and edge/arcuate interconnecting portions 37 which extend between the base surface 22 and individual plateau surfaces as again shown and similar to as at 34 in FIG. 2A for portions 24. The perimeter extending and arcuate or sloping skirts for either of the portions 24 and 26 assist in establishing any desired shaping or modification to each individual profile, such as which can also include irregular shapes, and which in combination creates a useful cargo supporting and drainage/ventilation feature extending between the underside of the cargo load (not shown and supported upon the plateau locations 34) and the base surface 22 of the load supporting article.

Figure 3:
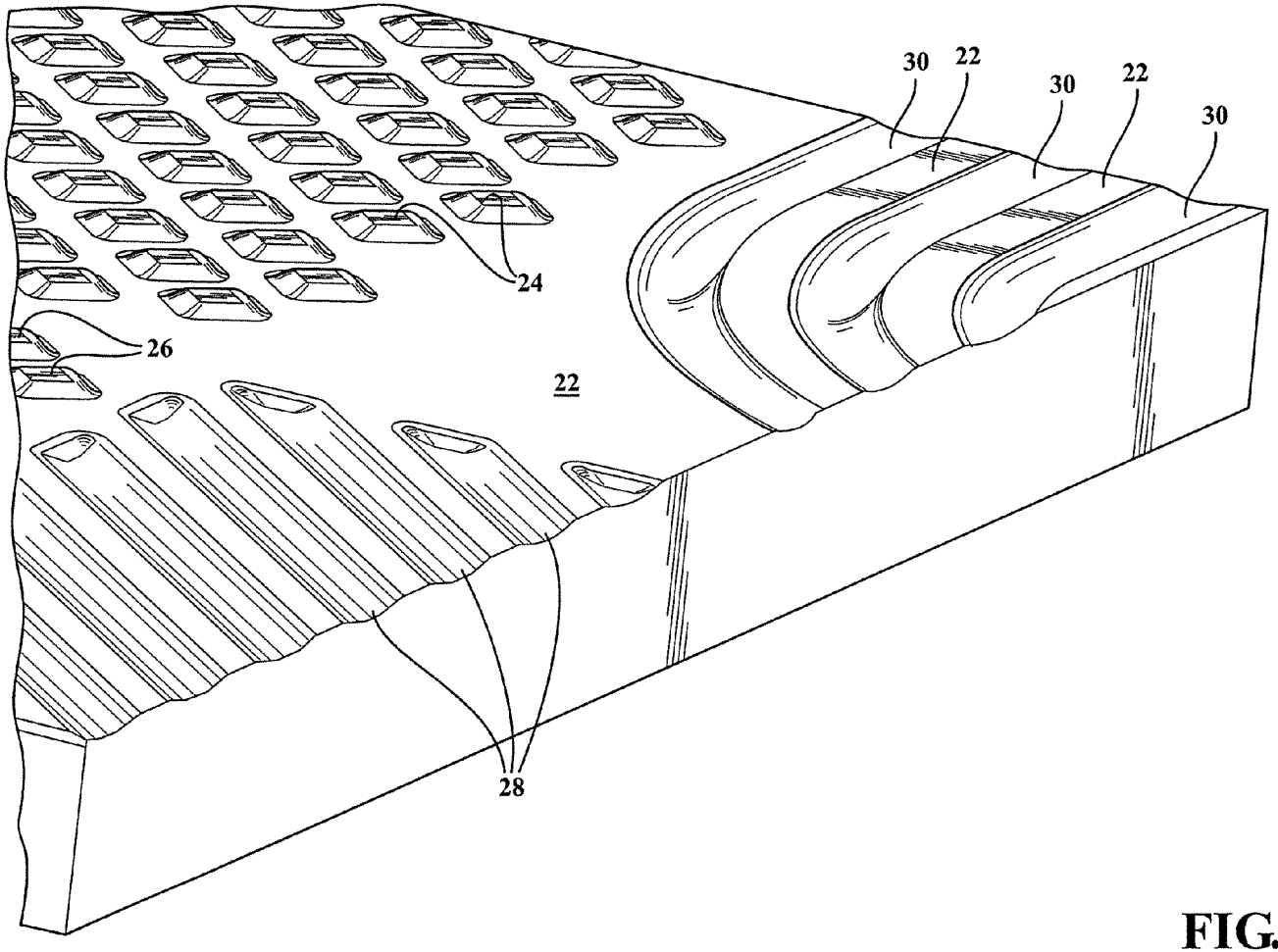
FIG. 3 is a further close up perspective in cutaway depicting second and third additional subset portions of pallet surface configurations along with the first raised subset portions of FIG. 2.

FIG. 3 is a further close up perspective in cutaway depicting additional variants of spaced apart subset portions of pallet surface configurations, again at 28 and 30 along with the previously described first raised subset portions 24 and 26 of FIGS. 2 and 2A. The configurations 28 and 30 are shown as elongated channels having arcuate profiles which are formed into the base surface 22 and which define a further version of drainage and ventilation functionality for communicating any built up gases and fluids existing at the boundary interface between the underside of the cargo load and the support surface 22, to each of the four sides of the article 10.

As is further understood, the channel configuration 28 and 30 of FIGS. 1 and 3 define recessed ventilation and drainage relative to the cargo supporting base surface 22, whereas the coplanar arranged central plateaus associated with the elevated areas or protuberances 24 and 26 provide the cargo support surface, with the base surface 22 functioning as the drainage and ventilation pathways to each of the four edges of the article. As such, the representations of FIGS. 1 and 3 are again both understood and intended to define a collection of alternating patterns which could be incorporated into the surface profiling of the load supporting article according to any desired combination, with the individual spaced apart portions 24, 26, 28 and 30 usually (but not necessarily) being provided singularly or in a combination which establishes a uniform and coplanar elevated surface (elevating portions 24 and 26) above the base surface 22, or a communicating edge extending channel network (portions 28 and 30) in which the base surface 22 is converted into the article supporting surface.

As shown in each of FIGS. 1 and 3, the recessed profiles established by the channels 28 and 30 are each spaced apart relative to the level surface 22 and are both elongated, with the selected sub-plurality 28 exhibiting a straight profile and the further selected sub-plurality each an arcuate profile 30. The construction of the individual pluralities of portions 28 and 30 are further recessed such that, in relation to the upper surface 22 of the article, they exhibit a similar irregular profile as provided between the other areas of the upper surface 22 and the upwardly projecting portions 24 and 26. These can further extend between any number or all of the interconnected side edges of the article 10, in individual or networking/grid fashion and again facilitates any or all of drainage, gaseous release and anti-sliding frictional engagement of cargo items supported upon the article. Without limitation, the base surface 22 of the article and/or the projecting and plateau defining surfaces of the indicated subset pluralities of spaced apart portions 24 and 26 can also exhibit a roughened or grit entrained surface to facilitate the frictional engaging properties of the article.

Figure 4:
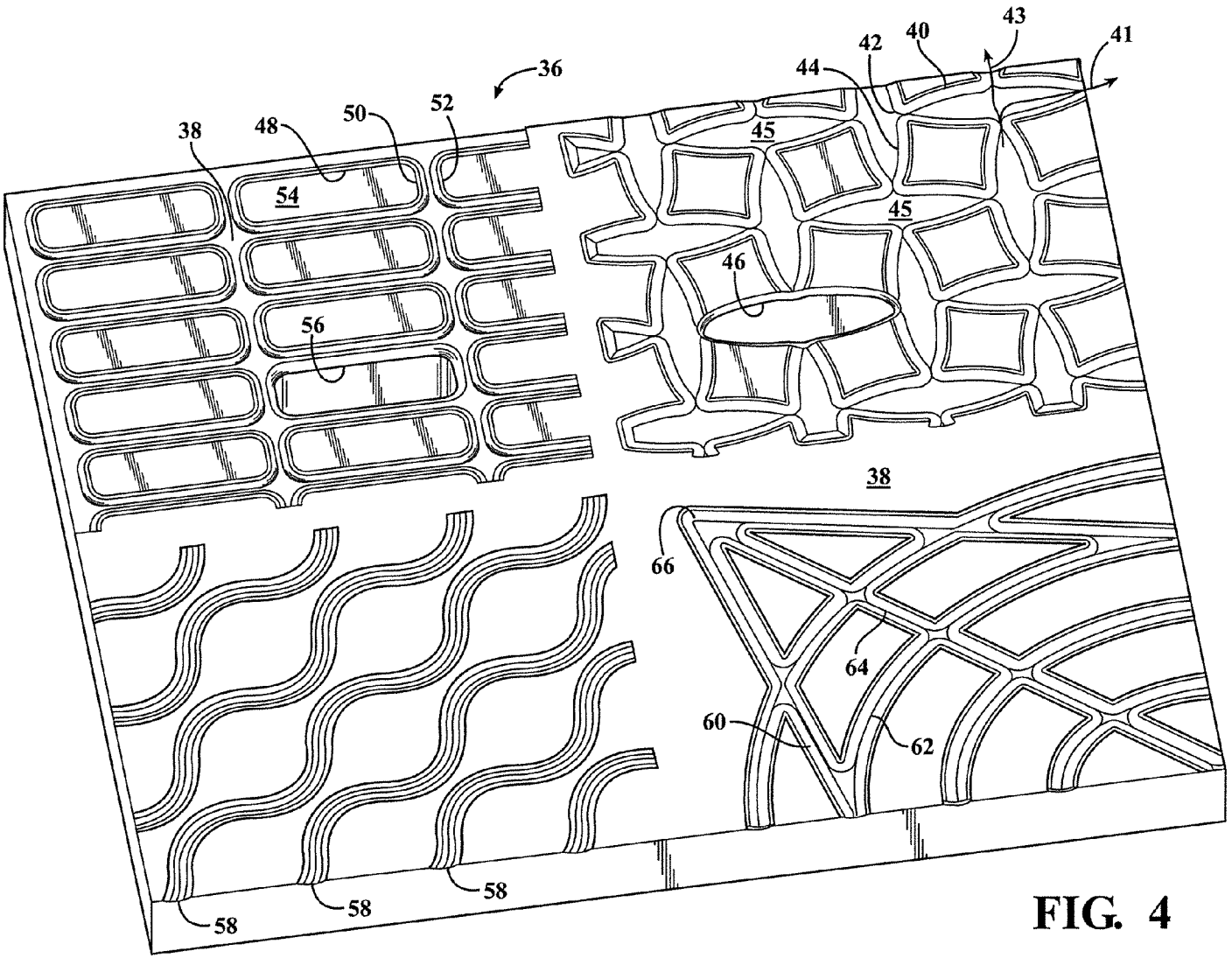
FIG. 4 is a perspective illustration of a pallet article with a variety of surface configured profiles according to another non-limiting embodiment of the present invention.

Proceeding to FIG. 4, a perspective illustration is generally shown at 36 of a pallet article with a variety of surface configured profiles, this represented by individual sub-pluralities of portions which are arranged in an individual quadrant disposed and exemplary/non-limiting representation according to additional non-limiting embodiment of the present invention. As with the previously described variants, the article 36 can include any of a pallet or other structurally supporting three dimensional body having a relatively level upper surface for supporting cargo items or the like and can further be molded or otherwise constructed of a solid plastic or any substrate or reinforced insert (such as a corrugated paperboard blank) which can be coated, sprayed or injection molded with a suitable polymeric or plasticized material (such as again including but not limited to any type of urethane or other aqueous resistant polymer based coating material which preserves the structural integrity of the underlying structural article be it corrugated paperboard, other polymeric molded materials or the like) and in order to achieve a desired configuration, pattern or network, such as shown.

To this end, it is further envisioned that, apart from a die or mold, a template can be provided which exhibits a desired pattern or arrangement of cutout patterns and which can be placed upon the upper surface of the article (also shown at 38), following which a built up later of a plasticized material can be applied to a desired thickness by any of coating, spraying, pouring or other suitable operation. As also previously described, the afore-mentioned template or insert can be designed so as to be placed within a mold and by which the plasticized material is injected over the top and usually along the interconnecting sides and bottom of the (inserted blank) article in a manner which creates an environmental sealing coating.

Figure 5:
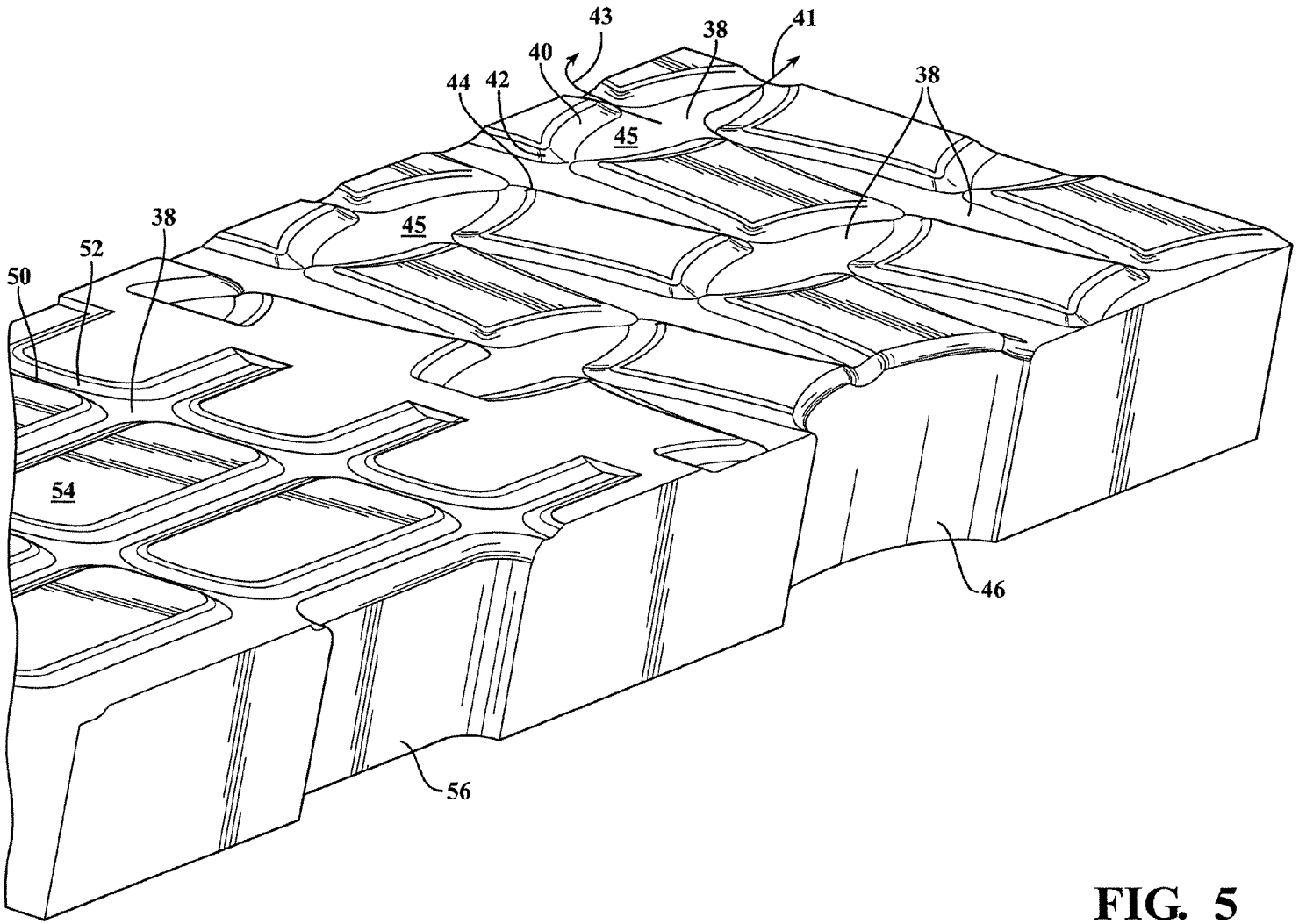
FIG. 5 is a close up perspective cutaway of the a first subset portion of raised surface areas associated with the pallet article of FIG. 4 and further exhibiting a through hole formed handle with surrounding recessed aperture defining profile.
Figure 6:
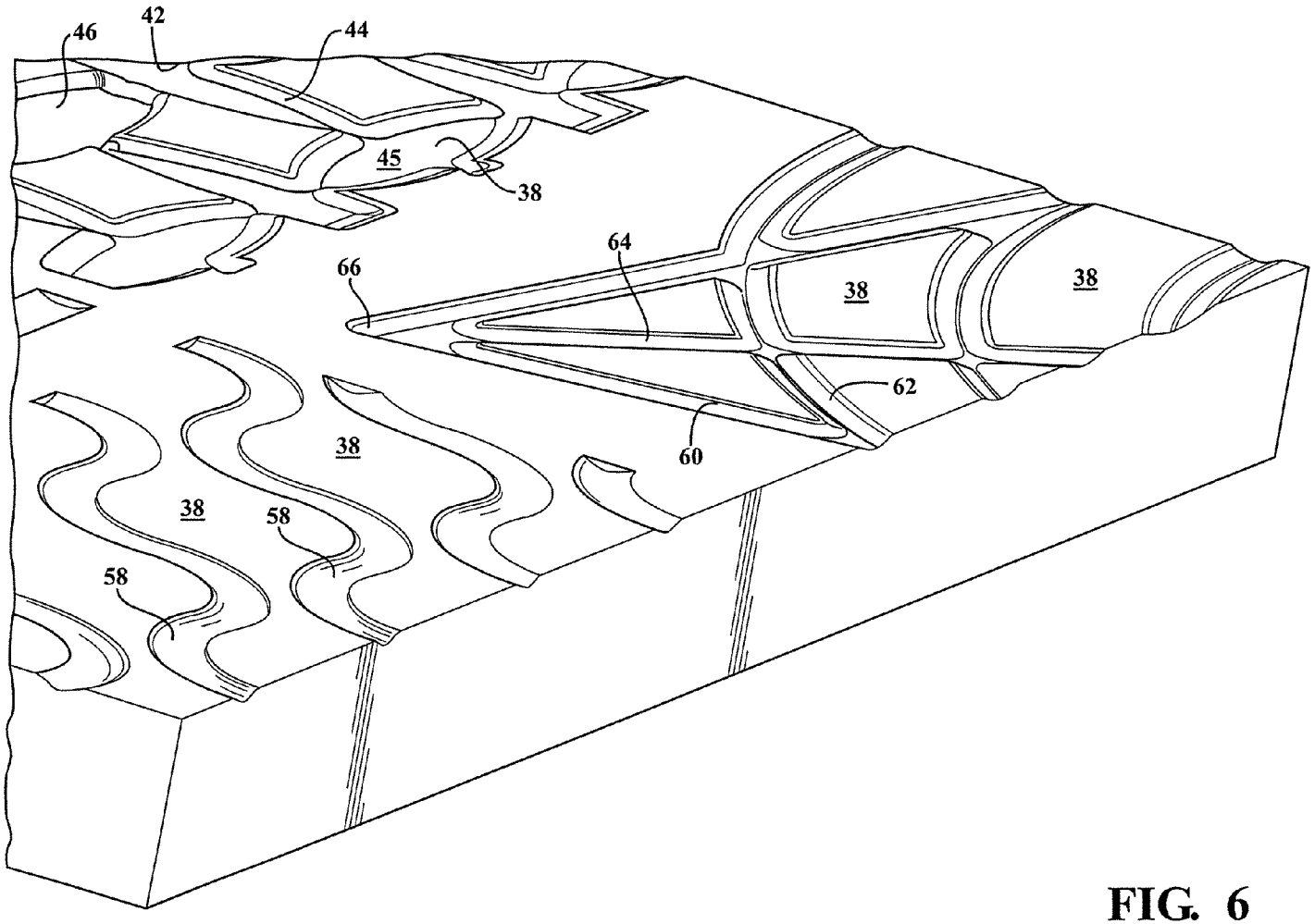
FIG. 6 is a further close up perspective in cutaway depicting second and third additional subset portions of pallet surface configurations along with the first raised subset portions of FIG. 4.

As further supported by succeeding cutaway perspectives in FIGS. 5-6, the further selected collection of individual subsets of surface configured portions of the article 36 (compared to as at 20 in FIGS. 1-3) include a first quadrant defined sub-plurality of interlinking and recessed sloping walls 40, 42, 44 et seq., which communicate with the upper (generally level) base surface 38 of the article 36 in an arrangement which establishes recessed flat surfaces, also termed central recessed depressions as at 45, and which are further exhibited by drainage and ventilation pathways (arrows 41, 43, et seq.) extending between the grid defined arrangement of the elongated and interconnecting ovals arranged in a grid pattern and the edges of the article 36. As with the example of FIG. 10, selected oval recesses can be reconfigured by the recessed flat surface 45 being removed (such as during the initial molding operation) and so that an oval extending inner rim 46 remains and which defines a hand-hold aperture within the article 36, such as which provides additional venting and drainage, as well as facilitating carry-ability of the article 36.

A further indicated quadrant of surface defined portions in FIG. 4 is exhibited by an alternate pattern of sloping walls 48, 50, 52, et seq., these exhibiting a generally rectangular irregular pattern and which extend in sloping, extending and interconnecting fashion between the upper surface (again at 38) and upper plateaus 54 (e.g. elevated as with portions 24/26 in the FIG. 1 examples as opposed to recessed as with channels 28/30 in FIG. 1 or recessed ovals 45 in grid pattern in FIG. 4). The sloping walls 48-52 are defined by an intersecting subset of the individually projecting and upwardly sloping edges extending between the base surface 38 and the plateaus 54. A further generally smooth edged inner rectangular profile is indicated at 56 (substituting for a selected irregular rectangular surface) and exhibits a further drainage/venting/carry-ability handhold which is of a shape consistent with the surrounding configured portions.

Additional irregular surface profiles are established by each of the wave shaped (undulating) individual recessed channels 58 (see also as shown in FIG. 6) and which are depicted as spaced apart ribbons each having an arcuate recess profile alternating with the smooth upper (base) surface 38 of the article. It is understood that the ribbon pattern 58 can be exclusively provided in a selected article and which can extend between opposite or interconnected sides of the four sided article as desired.

A fourth quadrant of the article 36 is further exhibited by additional inter-networking elongated and recessed channels, these shown at 60, 62, 64, et seq. and which can (without limitation) exhibit combinations of linear (60 and 64) and interconnecting arcuate (62) recess channels, such that a modified pointed or partial star configuration is formed (depicted in non-limiting fashion as interior located pointed end 66). Besides providing a decorative aspect to the design, it is understood that the recess channel network defined by the combination of triangular and arcuate intersecting recess channels can extend to each or all of the four sides of a suitable configured load supporting article and in order to establish a unique and useful drainage and ventilation aspect for the pallet supported cargo.

Without limitation, the recesses 58, 60, 62, 64, et. seq. can again be exhibited upon the article 36 as projections in order to define a similar irregular surface however it is understood that recesses are preferable in this particular instance to avoid the creation of individual isolated pockets and in order to facilitate the aspects of drainage and ventilation. As further shown in FIGS. 4-6, the network of recessed channels established between the individually configured networks of surface configured portions and the level surface 38 (and again whether established between the upwardly sloping projections 40, 42, 44 et. seq. and/or the similar projections 48, 50, 52, et. seq. relative to a lower base surface 38, or established between an upper load supporting base surface 38 relative to the network of recessed channels 58, 60, 62, et seq.) all extend to each of the four interconnecting outer edges of the body in order to facilitate the desired aspects of allowing escaping of liquids or gases which may build up underneath certain types of transported goods.

Figure 7:
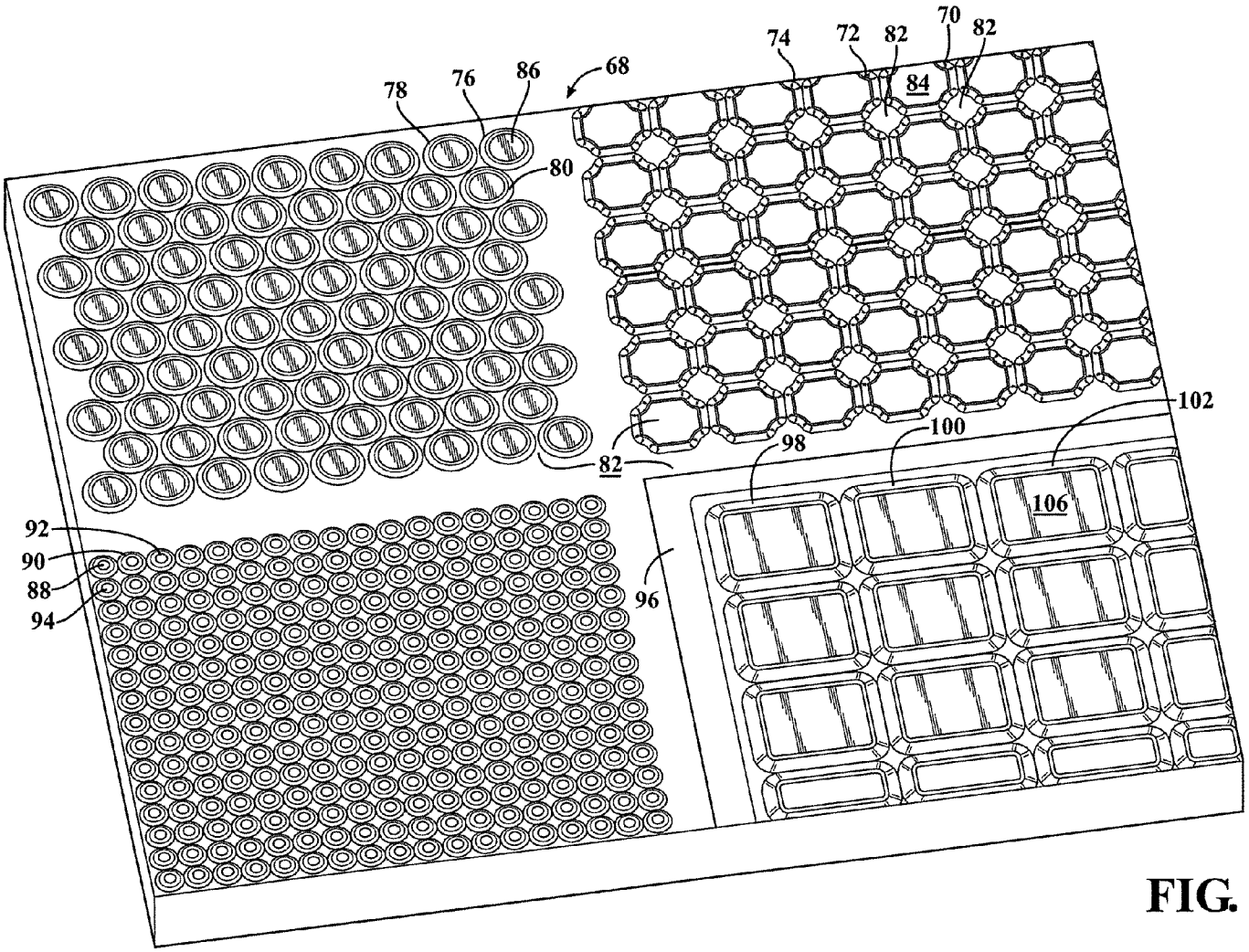
FIG. 7 is a perspective illustration of a pallet article with a variety of surface configured profiles according to a further non-limiting embodiment of the present invention.
Figure 8:
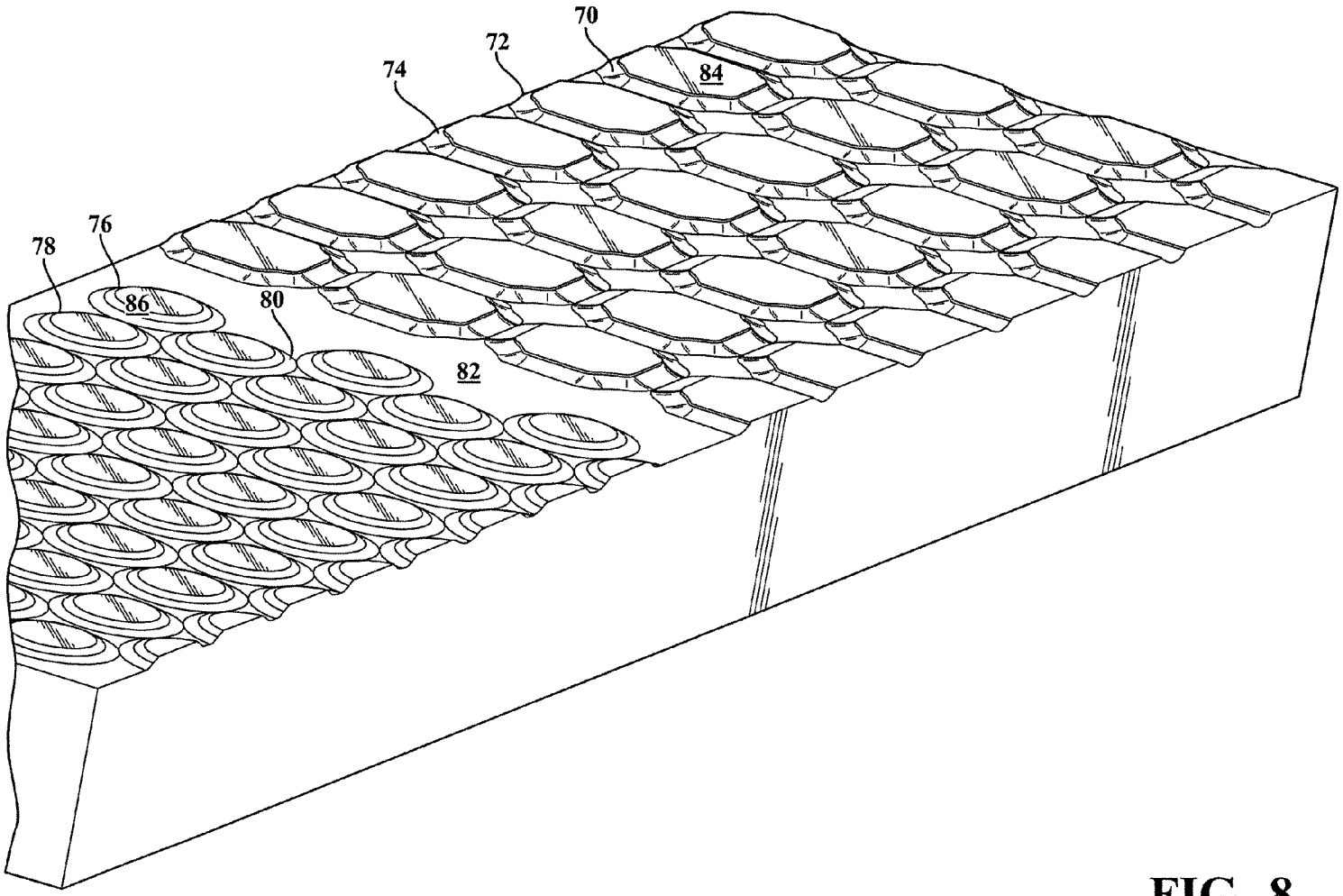
FIG. 8 is a close up perspective cutaway of first and second subset portions of pallet surface configurations defining alternating recessed and raised areas according to a third non-limiting embodiment of the present invention.
Figure 9:
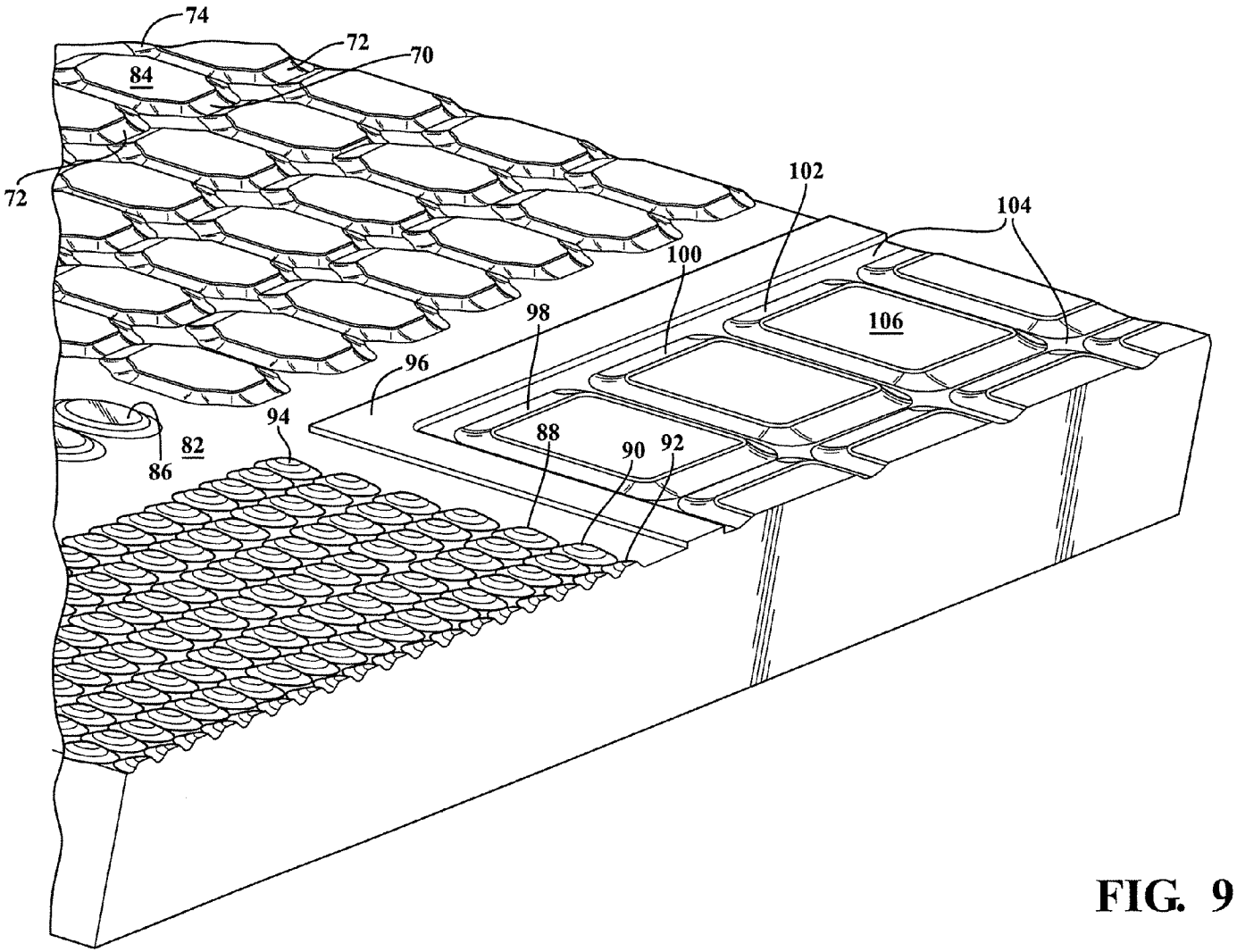
FIG. 9 is a further close up perspective in cutaway depicting each of the individual pluralities of configured surface profiles of the pallet article in FIG. 7.

FIGS. 7-9 depict a yet further perspective illustration (generally at 68 in FIG. 7) of a pallet article exhibiting a further variety of surface configured profiles, arranged in quadrants for purposes of ease of illustration, and according to another non-limiting embodiment of the present invention. Similar to the previous embodiments described, the structurally supporting article 68 (pallet or otherwise) exhibits, in a non-limiting and exemplary fashion, individual pluralities of raised areas which are better illustrated in the cutaway perspectives of each of FIGS. 8 and 9 by upwardly sloping perimeter extending portions 70, 72, 74, et seq. in one generally quadrant defining area, as well as by individual circular sloping walls or portions 76, 78, 80, et seq. in a further quadrant defining area.

As with the previously described variants, the sloping walls according to either of the afore-mentioned varieties again extend upwardly from a level upper surface 82 to establish upper plateau surfaces (at 84 for selected extending portions 70, 72, 74, et. seq. and further at 86 for selected circular sloping walls 76, 78, 80, et. seq.). In either instance, the network of the sloping edges is such that it establishes release channels with the (generally continuous and interconnecting) base surface 82 of the article 68 to facilitate venting and drainage along each of the outer interconnected edges of the article body, via pathways which are established between base surface 82 and the elevated plateau surfaces . . . formed therein depending upon the nature of the individual portions or areas.

FIG. 9 is a further close up perspective in cutaway depicting each of the individual pluralities of configured surface profiles of the pallet article in FIG. 7 and further best depicts an additional sub-plurality of surface configured circular projections and which is defined by a more tightly packed combination 88, 90, 92, et seq. of elevating circular or disk portions (as compared to the larger and offset arrangement of portions 76, 78, 80 et. seq.), however which still provides the necessary venting and drainage properties via the arcuate sides of the packed disks 88, 90, 92, et seq. The upper most raised or plateau surfaces (see again at 84 and 86 as well as further at 94 for the further indicated sub-plurality of circular and more tightly packed portions) provide additional gripping or anti-slip properties and can exhibit any type of grit, abrasive or other anti-slip enhancing properties.

A further sub-plurality of portions is best depicted in FIG. 9 by an outer "L" shaped perimeter or border, at 96, which can establish a cargo supporting load surface and which extends to side edge locations proximate one corner of the article 68 and which bounds a plurality 98, 100, 102 et. seq. of perimeter extending and sloping edged skirts or profile which extend upwardly from a recessed level surface (here depicted at 104 but understood in a non-limiting example to generally be either parallel or coplanar with upper surface 82 previously described). The perimeter extending and sloping skirts or perimeter edges 98-102, et seq., again terminate in upper plateau locations (e.g. at 106) which can again include an entrained grit or frictional promoting surface for engaging the underside of the cargo load, as previously described, as well as again in order to assist in establishing drainage and venting capabilities across the surface area of the article out to each of the four exterior edges.

Referring once again and finally to FIG. 10, the perspective illustration of the pallet style article 10, exhibits a plurality (at 108, 110, 112 and 114) of aperture defining handholds gripping handles, these of a generally similar nature to the handhold aperture profiles previously described and shown in 56 in FIG. 4 and in the form of rectangular inner perimeter edges with arcuate corners), and which provide the additional features of drainage and venting. As further previously described, upper most surface locations (e.g. plateau surfaces 116) are provided which alternate with the outer edge communicating and networking recess channels (sloping walls and interconnecting corners 118, 120, 122, et seq.) for providing drainage.

Figure 10:
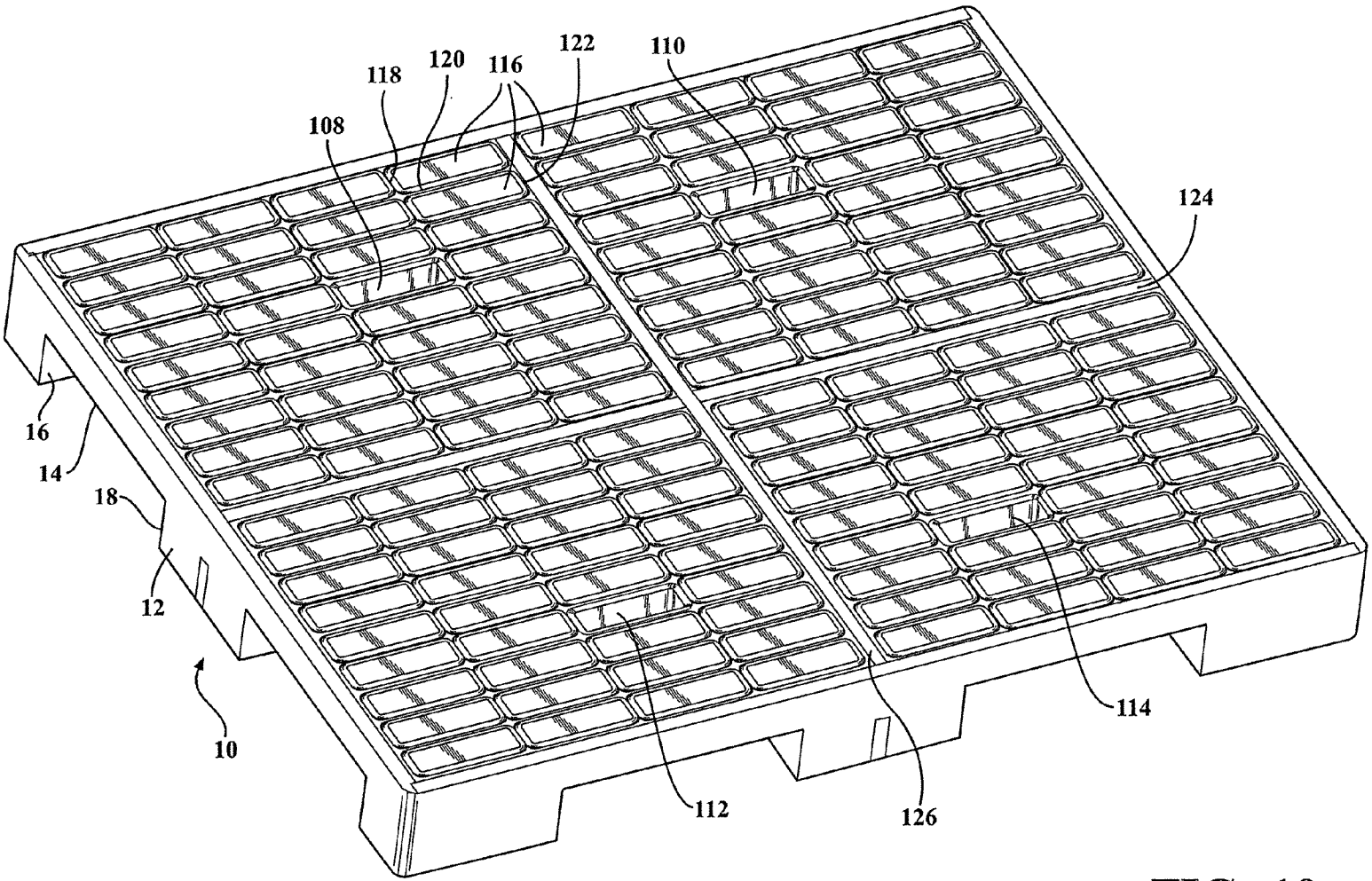
FIG. 10 is a perspective illustration of a pallet style article according to a still further embodiment and which exhibits a plurality of aperture defining gripping handles, support surface texturing for providing each of gaseous venting, draining, and frictional (non-slip) support.

The configuration of FIG. 10 further optionally exhibits crosswise extending and intersecting surface locations 124 and 126, separating the individual supporting locations into a four quadrant configuration (without limitation). As also previously described, the surface portion of the plasticized material can exhibit any type or manner of texturing or roughening (such as associated with entrainment of a grit particulate) for providing a combination of gaseous venting, draining, and frictional (non-slip) support.

Without limitation, the surface texturing can be used with or produced via any injection, compression or blow molding process. As also previously discussed, a structural supporting insert can from the inner skeleton of the body and which can include any of wood, Styrofoam, or other composite and over which a plastic coating can be sprayed or otherwise applied.

Additional variants of the invention can include any other perimeter defined shapes not limited to the generally rectangular profile shown. As also previously described, the thickness and/or underside accessible profile of the body can be varied from that shown as specified by the desired application and without departing from the scope of the invention.

Having described my invention, other and additional preferred embodiments will become apparent to those skilled in the art to which it pertains, and without deviating from the scope of the appended claims.

I claim:

1. A pallet article, comprising:

a body having a plurality of interconnected sides and an upper facing base surface;

a plurality of individual and spaced apart portions configured with and projecting upwardly from said upper facing base surface, said individual portions each including a perimeter edge extending and height defining portion merging into an elevated plateau;

a grit applied to each of said elevated plateaus to promote frictional engagement with a cargo supported upon said body; and said plateaus collectively defining a support surface for cargo placed upon said body such that said base surface is recessed below said support surface and is in planar communication with exposed edges associated with said sides, said perimeter edge extending and height defining portions establishing a network of channels between said base and cargo support surfaces, said channels defining an interconnecting network extending across a surface area of said body and in communication with each of said sides for providing for both drainage of fluids accumulating below the cargo and ventilation pathways.

2. The pallet article as described in claim 1, said plateau defining cargo support surfaces further comprising a textured surface to facilitate anti-slip of the cargo supported thereupon.

3. The pallet article as described in claim 2, said edge extending and height defining portions each further comprising upwardly sloping edges merging between said base surface and said individual plateaus.

4. The pallet article as described in claim 1, said body further comprising an injection molded plastic.

5. The pallet article as described in claim 1, further comprising at least one aperture defining and inner extending rim edge within said body in communication with said upper base surface for establishing a hand-hold as well as for facilitating drainage and ventilation.

6. A pallet article, comprising:

a body having a plurality of interconnected sides and an upper facing and load supporting surface;

a grit applied to said load supporting surface to promote frictional engagement with a cargo supported upon said body;

a plurality of elongated recessed patterns configured within said load supporting surface, such that said recessed patterns are in planar communication with exposed edges associated with said sides; and said depressions and associated depth defining perimeter edges collectively defining a network of channels below said load supporting surface and extending across a surface area of said body, said channels being in communication with a plurality of said sides for providing both drainage of fluids accumulating below the cargo and ventilation pathways.

7. The pallet article as described in claim 6, said elongated recessed patterns further comprising an interconnecting oval grid pattern.

* * * * *